US005205548A

United States Patent [19]

Yamada et al.

[11] Patent Number: 5,205,548

[45] Date of Patent: Apr. 27, 1993

[54] AUTOMATIC DOCUMENT SHEET CONVEYANCE DEVICE

[75] Inventors: Yasushi Yamada, Tokyo; Masaru Ushio, Hachioji; Masanobu Kawano, Hachioji; Yoshikazu Maekawa, Hachioji; Yoshio Ueda, Hachioji, all of Japan

[73] Assignee: Konica Corporation, Tokyo, Japan

[21] Appl. No.: 580,569

[22] Filed: Sep. 11, 1990

[30] Foreign Application Priority Data

Sep. 14, 1989 [JP] Japan ..... 1-238854

[51] Int. Cl.[5] ..... B65H 5/02

[52] U.S. Cl. ..... 271/3; 271/111; 271/270; 271/202

[58] Field of Search ..... 271/258, 259, 265, 270, 271/110, 111, 263, 314, 202, 203, 3

[56] References Cited

U.S. PATENT DOCUMENTS

| | | | |
|---|---|---|---|
| 4,725,053 | 2/1988 | Bastow | 271/270 X |
| 4,974,828 | 12/1990 | Matsuo | 271/202 X |
| 5,018,716 | 5/1991 | Yoshida | 271/270 X |
| 5,086,320 | 2/1992 | Koike | 271/202 X |

*Primary Examiner*—Richard A. Schacher

*Attorney, Agent, or Firm*—Finnegan, Henderson, Farabow, Garrett & Dunner

[57] ABSTRACT

An automatic document conveyer for use with a photoelectric copier which copies an image of a document at a platen of the photoelectric copier onto a copying sheet. The document conveyor includes a first conveyor part for conveying the documents one by one to the platen, and a second conveyor part for conveying the documents from the platen to the outside of the photoelectric copier after a copying operation. The first conveyor part conveys the documents at either a fast speed or a slow speed, and conveys the documents at the slow speed while a forwarded document is placed at the platen.

9 Claims, 10 Drawing Sheets

FIG. 7

$v_1 \geqq v_2$
$v'_1 \geqq v'_2$

| | | | | | | | | |
|---|---|---|---|---|---|---|---|---|
| SHEET FEEDING ROLLER STRUCTURE | 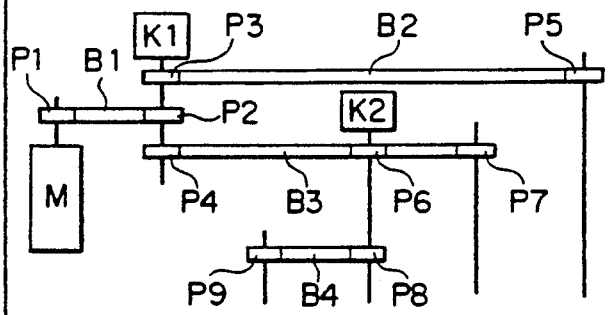 | | | | | | | |
| SHEET FEEDING ROLLER SHAFTS | | | PICKUP ROLLER CIRCUMFERENTIAL SPEED (2) | FEEDING BELT CIRCUMFERENTIAL SPEED (22) | INTERMEDIATE CONVEYANCE ROLLER CIRCUMFERENTIAL SPEED (23) | CONVEYANCE BELT CIRCUMFERENTIAL SPEED (9) | ELECTROMAGNETIC CLUTCH K1 | ELECTROMAGNETIC CLUTCH K2 |
| CONVEYANCE START PERIOD (FROM DOCUMENT SHEET CONVEYANCE START TO SUSPENSION) | | | $v'_1$ | $v'_1$ | $v_1$ | $v_1$ | ON | ON |
| EXPOSURE SCANNING PERIOD (DOCUMENT SHEET CONVEANCE SUSPENSION) | | | $v'_2$ | $v'_2$ | $v_2$ | 0 | OFF | ON |
| ADVANCING DOCUMENT SHEET EJECTION / FOLLOWING DOCUMENT SHEET FEED | | | $v'_1$ | $v'_1$ | $v_1$ | $v_1$ | ON | ON |

AUTOMATIC DOCUMENT SHEET CONVEYANCE DEVICE

BACKGROUND OF THE INVENTION

The present invention relates to an improvement of an automatic document sheet conveyance device to be used for a recording apparatus such as an electrophotographic copying machine.

An automatic document sheet conveyance device is usually mounted, when it is used, on a document table glass (platen glass) in an image exposure section of a copying machine and others. In a copying machine having a movable optical system on which the automatic document sheet conveyance device is mounted, a document in a sheet form (hereinafter referred to simply as a document) fed out one sheet by one sheet from a document tray (document stacking portion) on which documents are stacked is conveyed by a conveyance belt onto a platen glass where the document is exposed to an exposure lamp, and then ejected onto a document ejection tray.

In a document change operation on a platen glass by means of such an automatic document sheet conveyance device, both conveyance and ejection need to be performed in a short period of time for the purpose of avoiding the reduction of productivity of copying. Namely, it is preferable that the copying speed CPM (number of copies made in a minute) in an image forming process in a main frame of a copying machine is mostly the same as the document handling speed OPM (number of documents handled in a minute) in the automatic document sheet conveyance device.

For that purpose, if document changing is made within a period of returning time of a scanning optical system on the occasion of document changing by means of an automatic document sheet conveyance device wherein a document is automatically fed to and ejected from a platen glass, it is possible to keep the productivity of copying at 100% and there is no waste time.

In a copying machine capable of copying at a high speed, a document conveyance speed covering from the position for document double feed prevention in document stacking portion to the document stopping position as well as a document ejection speed for ejecting out the document from the document stopping position are set to be high.

However, when a document ejecting speed is set to be high, a contact area between a running conveyance belt and a platen glass, within a predetermined period of time, increases during the course of document ejection wherein a document moves on the platen glass, and thereby friction resistance also increases. Due to the increase in the friction resistance of the conveyance belt, the load for a driving motor increases, resulting in an increase of power consumption and over heat caused by an excessive load on the driving motor. Further, the conveyance belt slips on a driving roller that drives the conveyance belt and the driving roller runs idle, resulting in damage of the conveyance belt, the driving roller and bearings. Therefore, a large-sized motor having a large driving torque is needed, which is a problem.

The first object of the invention is to solve the aforesaid problems in an automatic document sheet conveyance device and thereby to improve the productivity of copying.

In a conventional copying machine, even when continuous copying is suspended in a series of continuous copying because of exhaustion of copy paper, it is possible to start the continuous copying again for continuation by pushing a start button after loading copy papers without necessity of setting the number of necessary copies in the period of the suspension. Therefore, it is possible to obtain easily the copies in exact quantity set in the beginning for each of documents stacked on a document tray. However, when the setting of the number of copies such as a ten-key operation including the pressing of a clear key in the period of suspension caused by the exhausting of copy papers, copying operation started thereafter by pushing a start button becomes, without being a continuation of a series of copying operations suspended on the half way, a new series of copying operations for obtaining copies in quantity set newly. In that case, a conventional copying machine has been arranged so that a document positioned at the exposure section when the number of copies has been set may be ejected onto a document ejection tray.

In a conventional copying machine such as one stated above, document conveyance from the document tray to the exposure section has always been made separately for each document. Therefore, when each document is conveyed to the exposure section, it equally and fully takes the period of time calculated by dividing the conveyance path length from the document tray to the exposure section by the conveyance speed. Thus, it takes time to finish a series of copying operations, which is a problem.

The invention has been devised also to solve the aforesaid problems, and the second object of the invention is to offer a copying machine provided with an automatic document sheet conveyance device wherein a series of copying operations by means of an automatic document sheet conveyance is performed efficiently and thereby the productivity of copying is high and it is further possible to start without trouble a series of copying operations by pushing a start button with new setting of the number of copies when the setting of the number of copies is made during the suspension caused by the exhausting of copy papers on the half way.

Further, in a conventional copying machine provided with an automatic document sheet conveyance device such as one stated above, the speed for ejecting a document in case of jamming taking place in a copy paper conveyance system has been the same as that for feeding the document into the exposure section and for ejecting, concurrently with the foregoing, the exposed document from the exposure section. For the purpose of raising the productivity of copying in a copying machine provided with an automatic document sheet conveyance device, therefore, when the speed for feeding the document to the exposure section is raised, and when a certain arrangement is made wherein the second document or thereafter is fed, while the preceding document is in the exposure section, to the standby position where the leading edge of the second document or thereafter is close to the trailing edge of the preceding document in the exposure section, and thus the second document or thereafter is fed to the exposure section concurrently with the ejection of the previous document, the document in the exposure section and the document in the standby position hit or overlap partially each other, resulting in jumping out of a document ejection tray or overlapping on the document ejection tray, causing the documents to be easily in wrong order.

The invention has been devised to solve also the aforesaid problems, and the third object of the invention is to offer a copying machine provided with an automatic document sheet conveyance device capable of making copies efficiently and capable of continuing copying operation easily despite jamming taking place in the copy paper transport path and further a document can always be ejected properly onto a document ejection tray.

SUMMARY OF THE INVENTION

An automatic document sheet conveyance device of the invention for achieving the aforesaid first object wherein a document is separated one by one from the stack of documents loaded on a document tray therein and is fed to and stopped at an image exposure section where the scanning exposure is made by the movement of an optical system and finally is ejected, after the exposure, onto a document ejection tray, is characterized by the document-ejection speed at which the last document, after being exposed, is ejected from the exposure section to the outside of the device by a conveyance means which is lower than that for other documents.

The aforesaid second object is achieved by a copying machine provided with an automatic document sheet conveyance device wherein the second document or thereafter is fed, while the preceding document is in the exposure section, to the standby position where the leading edge of the second document or thereafter is close to the trailing edge of the preceding document in the exposure section, and thus the second document or thereafter is fed to the exposure section concurrently with the ejection of the preceding document, and when the setting operation including the clear of the number of copies is made during the period of suspension caused by the exhaustion of copy papers on the half way of a series of copying operations, both the document in the exposure section and the document in the standby position are ejected onto a document-ejection tray, and copying operation started thereafter by pushing a start button becomes, without being a continuation of a series of copying operations suspended on the half way, a new series of copying operations.

Namely, since the second document or thereafter is fed from the document tray to the standby position during the period of copying operations for the preceding document in a copying machine provided with an automatic document sheet conveyance device of the invention, the time required for feeding the second document or thereafter does not need to be included in the period of time for feeding a document to the exposure section. Therefore, the time required for feeding the second document or thereafter to the exposure section is reduced, when compared with that in a conventional copying machine, by the period of time obtained by dividing the length of transport path from the document tray to the standby position with the speed for feeding to the exposure section, and the effect of such reduction of feeding time is not lessened even when the speed for feeding the second document or thereafter from the document tray to the standby position is lowered for the purpose of preventing the double feeding of documents. Further, when the number of copies is set during the period of suspension of copying operations caused by the exhausting of copy papers on the half way of a series of copying operations, both the document in the exposure section and the document in the standby position are ejected onto a document ejection tray, and when the start button is pressed next, a new series of copying operations is to be started instead of the continuation of the preceding series of copying operations. Therefore, it is possible to be free from the problem that a document staying in the exposure section or a document staying in the standby position on the occasion of the suspension disturbs a new series of copying operations.

A copying machine provided with an automatic document sheet conveyance device of the invention for achieving the aforesaid third object wherein a document of a sheet type is fed from a document tray one by one to an exposure section, and the document is ejected onto a document ejection tray after it is exposed for the number of times equivalent to the number of copies set for the document, and when jamming takes place in the copy paper transport system, aforesaid document conveyance system ejects the document which has left the document tray and is in the document conveyance system onto the document ejection tray for the suspension of the operation, is characterized in that the second document or thereafter is fed to the standby position where the leading edge of the second document or thereafter is close to the trailing edge of the preceding document in the exposure section for standing by while the preceding document is staying in the exposure section and then is fed to the exposure section concurrently with the ejection of the preceding document in the exposure section, and the speed for ejecting the document to the document ejection tray on the occasion of jamming taking place in the copy paper transport system is lower than that for feeding a document to the exposure section.

Namely, in a copying machine provided with an automatic document sheet conveyance device, even if the second document or thereafter is fed to the standby position where the leading edge of the second document or thereafter is close to the trailing edge of the preceding document in the exposure section for standing by while the preceding document is staying in the exposure section and then is fed to the exposure section concurrently with the ejection of the preceding document in the exposure section, it is possible to raise the productivity of copying in the case of no jamming because the speed for ejecting the document to the document ejection tray on the occasion of jamming taking place in the copy paper transport system is set to be lower than that for feeding a document to the exposure section. Even in the case of jamming taking place, the document can be ejected correctly onto the document ejection tray and thereby it is possible to return to the document tray the document ejected because of jamming for easy continuation of copying.

BRIEF DESCRIPTION OF THE DRAWINGS

FIG. 7 is a table showing the rotating speed of each paper feed roller given by the driving system.

DETAILED DESCRIPTION OF THE INVENTION

Figure 1:
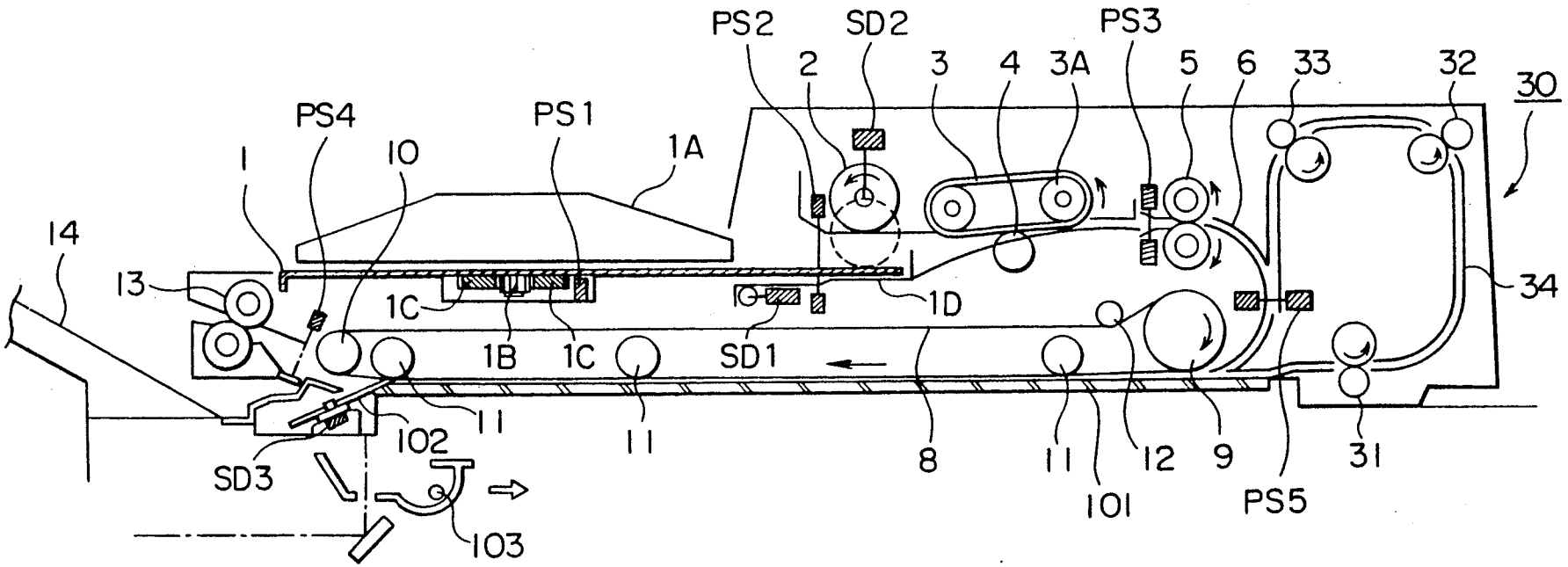
FIG. 1 is a construction diagram showing a document conveyance path in an automatic document sheet conveyance device of the invention.

An example of the invention will be explained in detail as follows, referring to the drawings.

Figure 2:
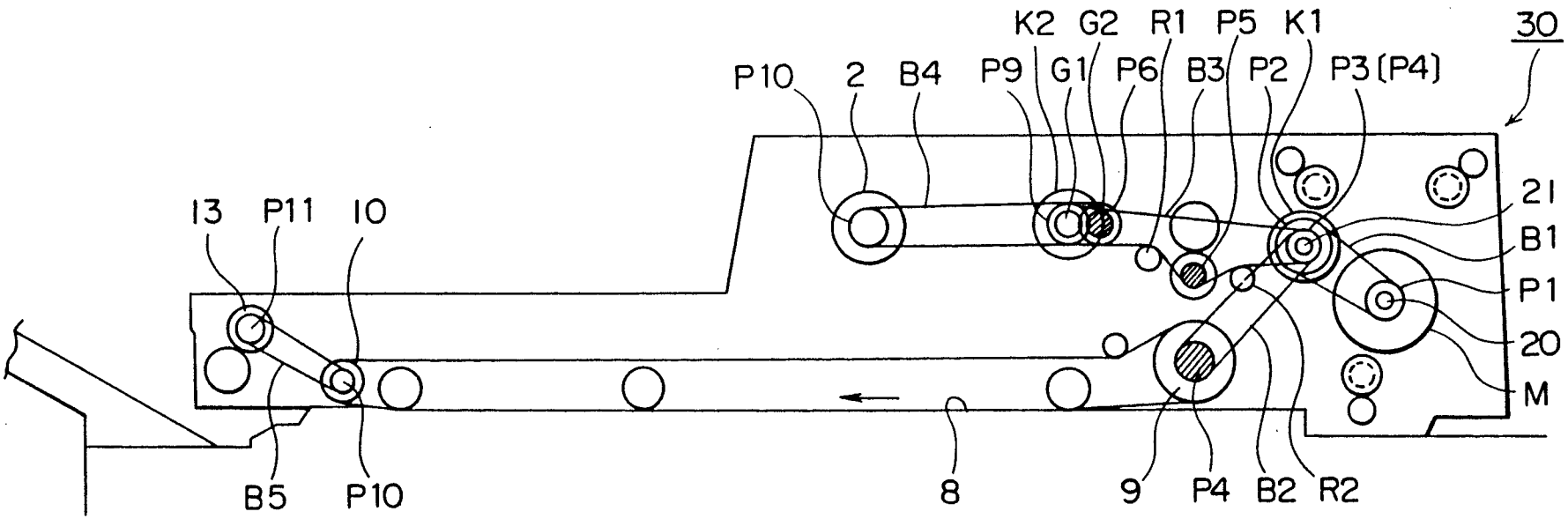
FIG. 2 is a construction diagram showing a driving system (power transmission system) of an automatic document sheet conveyance device.
Figure 3:
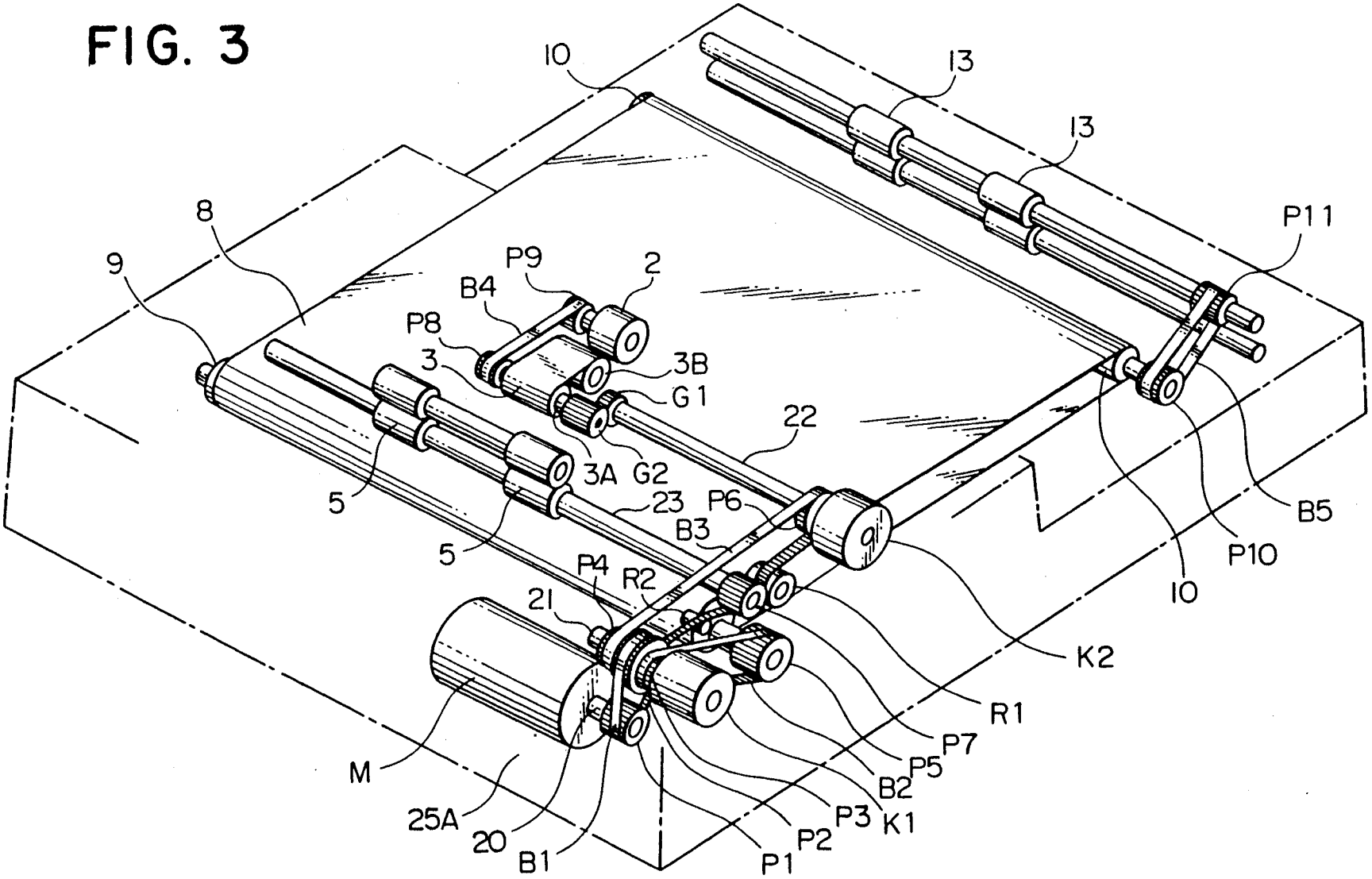
FIG. 3 is a perspective view showing the document transport system and driving system both in the aforesaid device and FIG. 4 is a plan view of a primary portion of the automatic document sheet conveyance device. Further.
Figure 4:
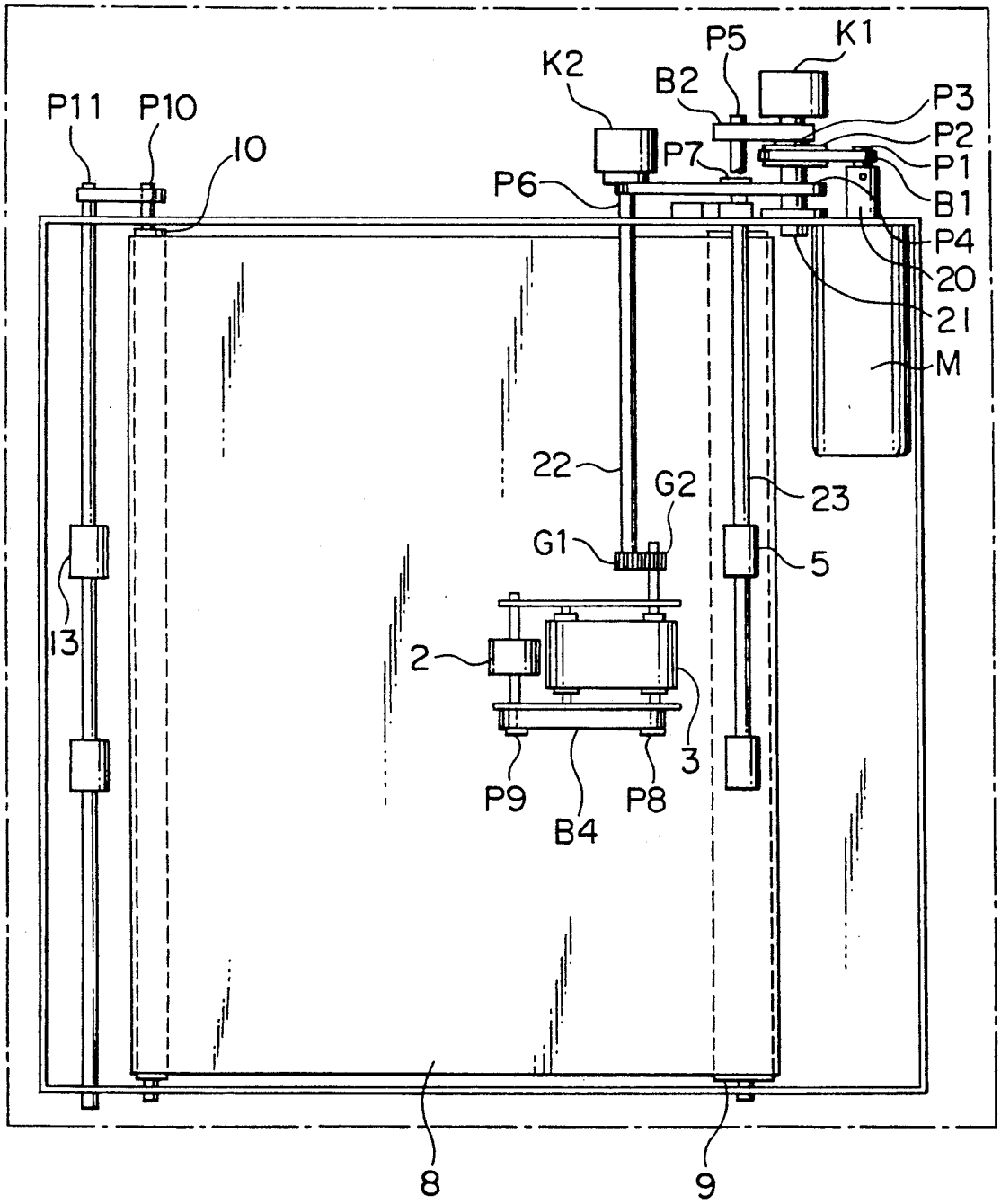
Figure 5:
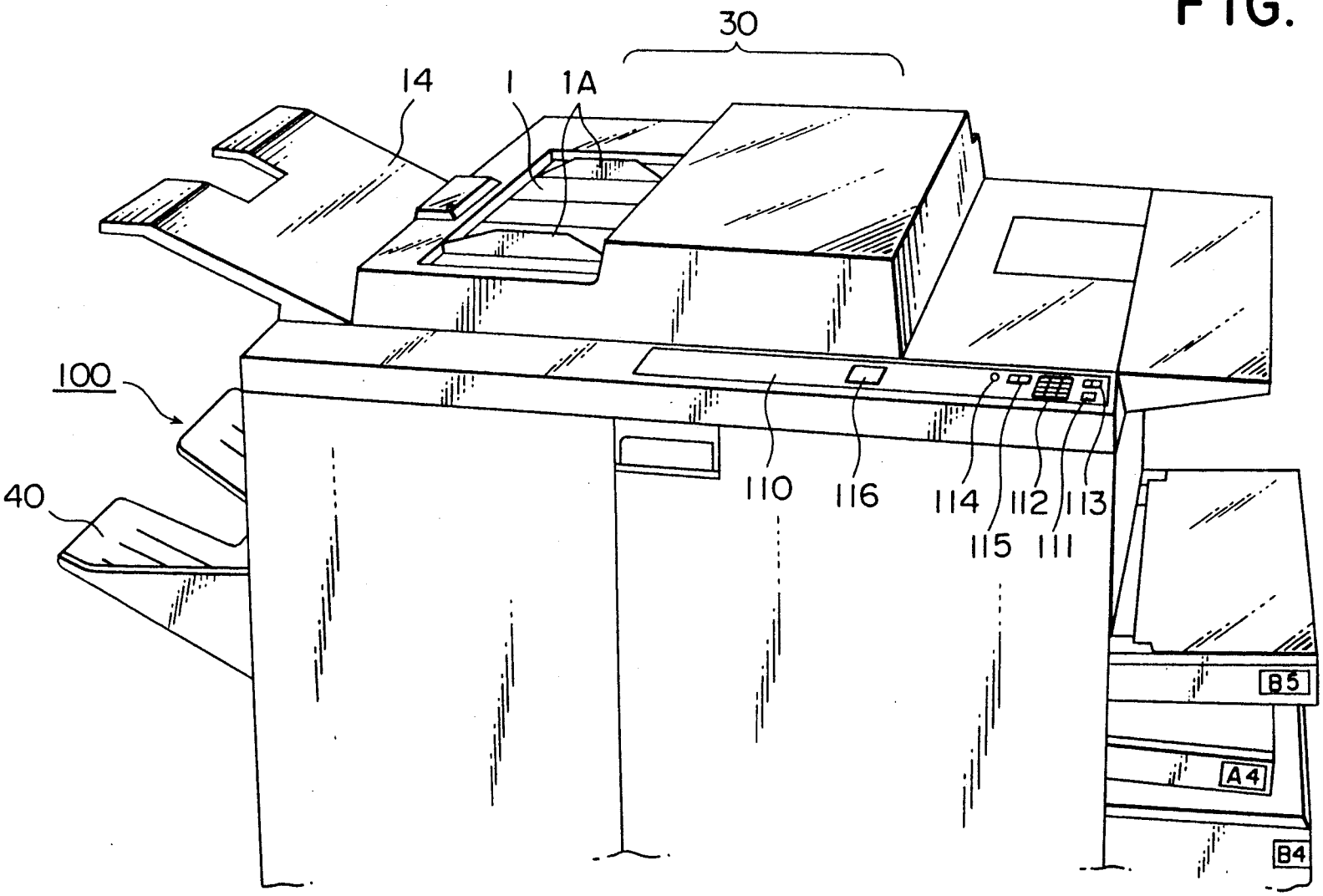
FIG. 5 is a perspective sketch of the upper portion of a copying machine provided with an automatic document sheet conveyance device.
Figure 6A:
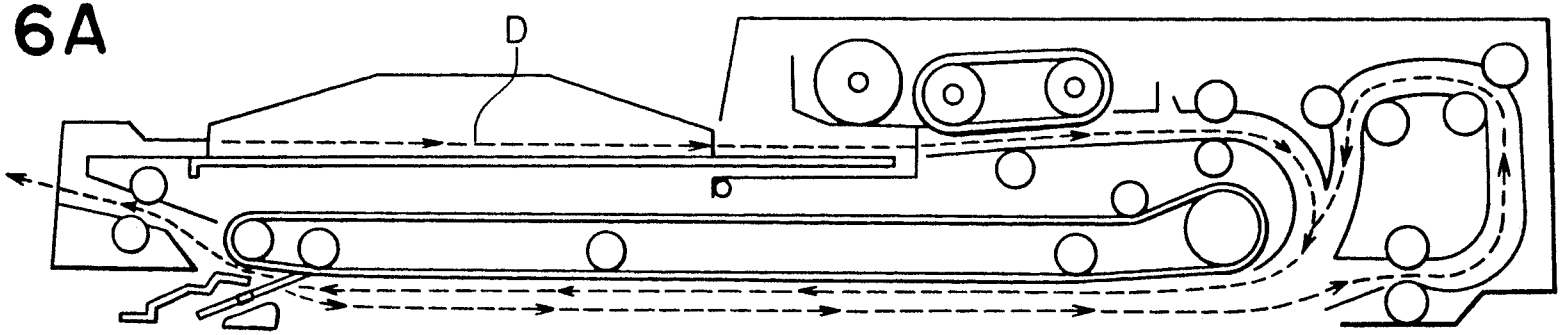
FIGS. 6 (A), (B) and (C) are illustrations showing how the document is transported.
Figure 6B:
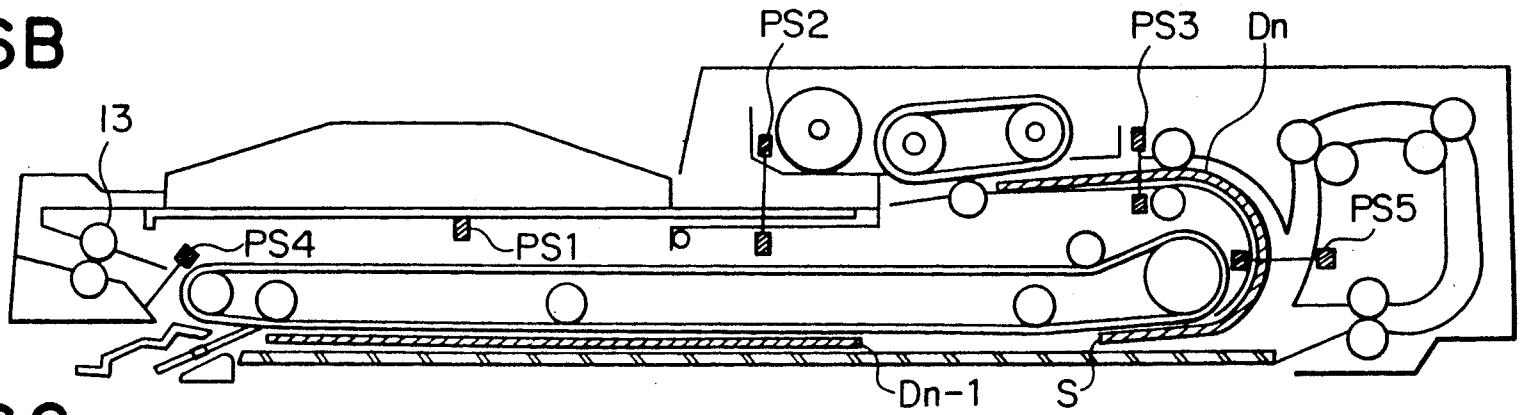
Figure 6C:
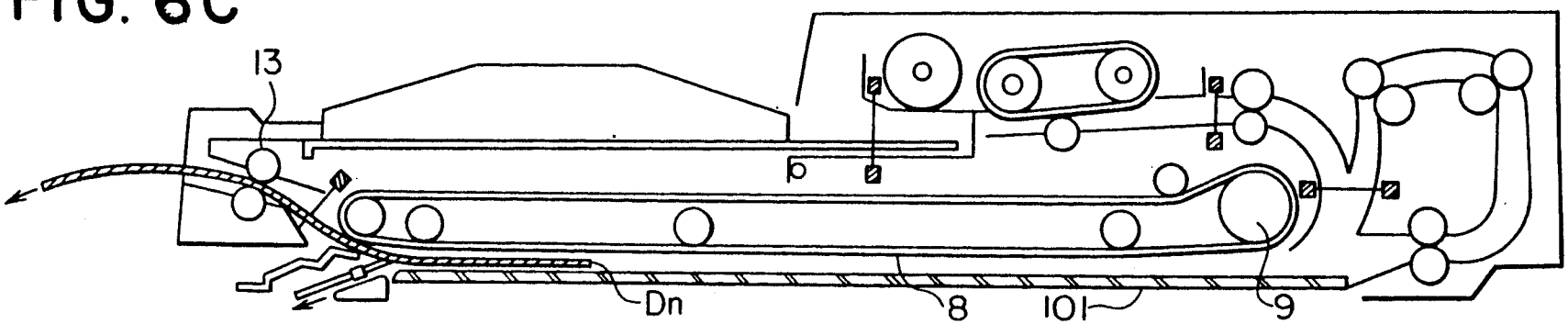

FIG. 1 is a construction diagram showing a document conveyance path in an automatic document sheet conveyance device of the invention, FIG. 2 is a construction diagram showing a driving system (power transmission system) of an automatic document sheet conveyance device, FIG. 3 is a perspective view showing the document transport system and driving system both in the aforesaid device and FIG. 4 is a plan view of a primary portion of the automatic document sheet conveyance device. Further, FIG. 5 is a perspective sketch of the upper portion of a copying machine provided with an automatic document sheet conveyance device. FIGS. 6 (A) is an illustration showing a document conveyance path. Incidentally, the device illustrated is an automatic document sheet conveyance device (RADF) having a function for reversing documents automatically.

First, structure and operation of the automatic document sheet conveyance device will be explained referring to FIG. 1, FIG. 3, FIG. 5 and FIG. 6 (A).

There is provided on the upper portion at left side of the automatic document sheet conveyance device the document tray 1 capable of being loaded with a stack of documents. On the lower side at the tip of document tray 1, there are provided document-setting solenoid SD1 and document leading edge stopper lD capable of being swung by the document-setting solenoid. Stacked documents are loaded on document tray 1 in a way that the leading edge of the stack of documents is in contact with aforesaid document leading edge stopper lD whose upper end portion is protruded from the surface of a front portion of document tray 1, thus, the edges of the stacked documents are trued up.

When stacked documents are loaded on document tray 1, document set detection sensor (document zero sheet detection sensor) PS2 detects the existence thereof and an ADF mode appears on control panel 110 of copying machine main frame 100.

On aforesaid document tray 1, there are provided document side edge guide plates 1A and 1A. These document side edge guide plates 1A and 1A are connected respectively to rack gears 1C and 1C which are in mesh with pinion gear 1B and can slide laterally and oppositely each other beneath document tray 1, and thereby can move symmetrically about the center of document tray 1. These rack gears 1C and 1C are connected respectively to document side edge guide plates 1A and 1A and an amount of the movement thereof is detected by document size detection sensor PS1, thus the document size in lateral direction can be read. Based upon the value thus read, the length of document D in standard size can be obtained automatically through conversion. Therefore, when stacked documents are placed on document tray 1 and document side edge guide plates 1A and 1A are slid until they contact the side edges of documents, sizes which, in other words, are lengths of various documents are stored.

On the upper part of the front portion of document tray 1, there is provided pick-up roller 2 in a way that it may move vertically by means of the operation of sheet-feed solenoid (latch type) SD2 and of spring pressure, and may rotate by means of driving force of driving motor M. Through the operation of copy button on aforesaid control panel 110, the automatic document sheet conveyance device is started and aforesaid sheet-feed solenoid SD2 is energized for eperation, then pick-up roller 2 linked thereto is lowered until it contacts, with pressure, the uppermost document in stacked documents and concurrently with that, pick-up roller 2 is rotated by the driving force of driving motor M, thus a document is fed out.

Downstream aforesaid pick-up roller 2 in terms of document feeding direction, there is provided sheet-separation-feeding means composed of feed-belt 3 that engages with feed-roller 3A for rotating it and of double-feed-prevention roller 4 located thereunder. The sheet-separation-feeding means separates and feeds only the uppermost document among a plurality of documents fed out by aforesaid pick-up roller 2 operated by the driving force of driving motor M transmitted through electro-magnetic clutch K.2.

Downstream aforesaid sheet-separation-feeding means in terms of document feeding direction, there are provided through document detection sensor SP3, intermediate conveyance roller 5 and curved guide plate 6.

A sheet of document fed out by sheet-separation-feeding means is detected, in terms of the passage of its leading edge, by through document detection sensor PS3, conveyed by a pair of intermediate conveyance roller 5 located in the vicinity thereof and further conveyed through guide plate 6. When the leading edge of the document passes the through document synchronism sensor (through reversed document detection sensor) PS5 arranged on inbetween position of the conveyance path, detection signals are generated and the document conveyance is controlled accordingly. The through document synchronism sensor PS5 controls, through a timer, the actions of document stopper 102 stated later, driving motor M, sheet-clutch K2 and conveyance clutch K1.

After that, the document is transported while it is sandwiched with pressure between running conveyance belt 8 and glass of document stand for document image exposure located on the top of main frame 100 of a copying machine (hereinafter referred to as platen glass) 101, and stops at the position where the leading edge of the document hits document stopper 102 which is caused to be protruded from the upper surface at left edge of platen glass 101 by the action of document stopper solenoid (latch type) SD3.

Aforesaid conveyance belt 8 is spread between conveyance belt driving roller 9 and driven roller 10 with three document holding rollers 11A, 11B and 11C as well as tension roller 12 all engaging with the conveyance belt.

The document is exposed by scanning exposure unit 103 in the main frame of a copying machine at the stop position on platen glass 101, and scanning by means of a optical system composed of a lens, mirrors and others causes images on the document to be formed on a recording medium.

When a series of copying processes for a document is completed, a stopper portion of aforesaid document stopper 102 withdraws from the upper surface of platen glass 101 to release the leading edge of the document, and thereby the document is conveyed by conveyance belt 8 resumed running and a pair of sheet-ejection rollers 13 and then ejected onto sheet-ejection tray (document ejection stand) 14 after the passage of the trailing edge of the document is detected by document ejection detection sensor PS4.

Further, the automatic document sheet conveyance device is provided with document-reversing section 30 that reverses the document by means of a document reversing path. The document-reversing section 30 is provided with the through reversed document detection sensor PS5 that detects a document passing through conveyance rollers 31, 32 and 33, guide plate 34 and the inside of the document-reversing section 30.

Next, the power-driving system for the aforesaid group of rollers and belts will be explained, referring to FIGS. 2, 3 and 4.

Driving motor M is a servomotor wherein a DC motor and a speed control device (encoder or tachogenerator) are united. Between sprocket pulley P1 united with driving shaft 20 of the servomotor M on a coaxial basis and sprocket pulley P2 fixed on intermediate shaft 21, there is spread timing belt B1, and intermediate shaft 21 is rotated by the powered-rotation of driving motor M.

On the aforesaid intermediate shaft 21, sprocket pulleys P3 and P4 and electromagnetic clutch K1 are affixed on a coaxial basis in addition to aforesaid sprocket pulley P2. Between the sprocket pulley P3 and sprocket pulley P5 which is affixed on the tip of aforesaid conveyance belt driving roller 9, timing belt B2 is spread so that it may mesh with them for running.

The rotation of aforesaid conveyance belt driving roller 9 causes driven roller 10 to rotate through conveyance belt 8, and sprocket pulley P10 affixed on the tip of the shaft of driven roller 10 meshes with sprocket pulley P11 through timing belt B5 to rotate sheet-ejection roller 13.

Further, timing belt B3 covering partially the external surface of sprocket pulley P4 affixed on the aforesaid intermediate shaft 21 for meshing therewith is spread between sprocket pulley P6 affixed on the tip of feed roller shaft 22 that rotates feed roller 3A through gears G1 and G2 and sprocket pulley P7 affixed on the tip of intermediate conveyance roller shaft 23 that is united with intermediate conveyance roller 5, to cover partially and mesh with sprockets on external surface on each of them. Incidentally, each of R1 and R2 is a tension roller that contacts the external surface of aforesaid timing belt B3 for giving it tension.

Being driven by timing belt B3 that is running, feed roller shaft 22 that is connected solidly to sprocket pulley P6 on a coaxial basis causes feed roller 3A to rotate through gears G1 and G2, thereby causes feed belt 3 that is spread even to driven roller 3B to run, and further causes pick-up roller 2 to rotate through sprocket pulleys P8 and P9 and timing belt B4. On the other end of feed roller shaft 22, on the other hand, there is provided electromagnetic clutch K2 that is controlled by inputted signals to cause aforesaid feed belt 3 to run and to cause pick-up roller 2 to rotate for feeding a document.

When copying a two-sided document, the document whose one side has been exposed through the process mentioned above is conveyed toward right on platen glass 101 by conveyance belt 8, because conveyance belt driving roller 9 starts rotating counterclockwise synchronizing with the completion of the exposure. The right edge portion of the document thus conveyed is fed into aforesaid document-reversing section 30. Accordingly, after the document D is conveyed by conveyance rollers 31, 32 and 33 in succession along guide plate 34 in document-reversing section 30, the right edge portion of the document D, namely the leading edge of the document in this case is fed out onto platen glass 101, and in advance of the foregoing, the leading edge of the document changes the direction of rotation of aforesaid conveyance belt driving roller 9 to clockwise one again based on signals from through reversed document detection sensor PS5.

Figure 8:
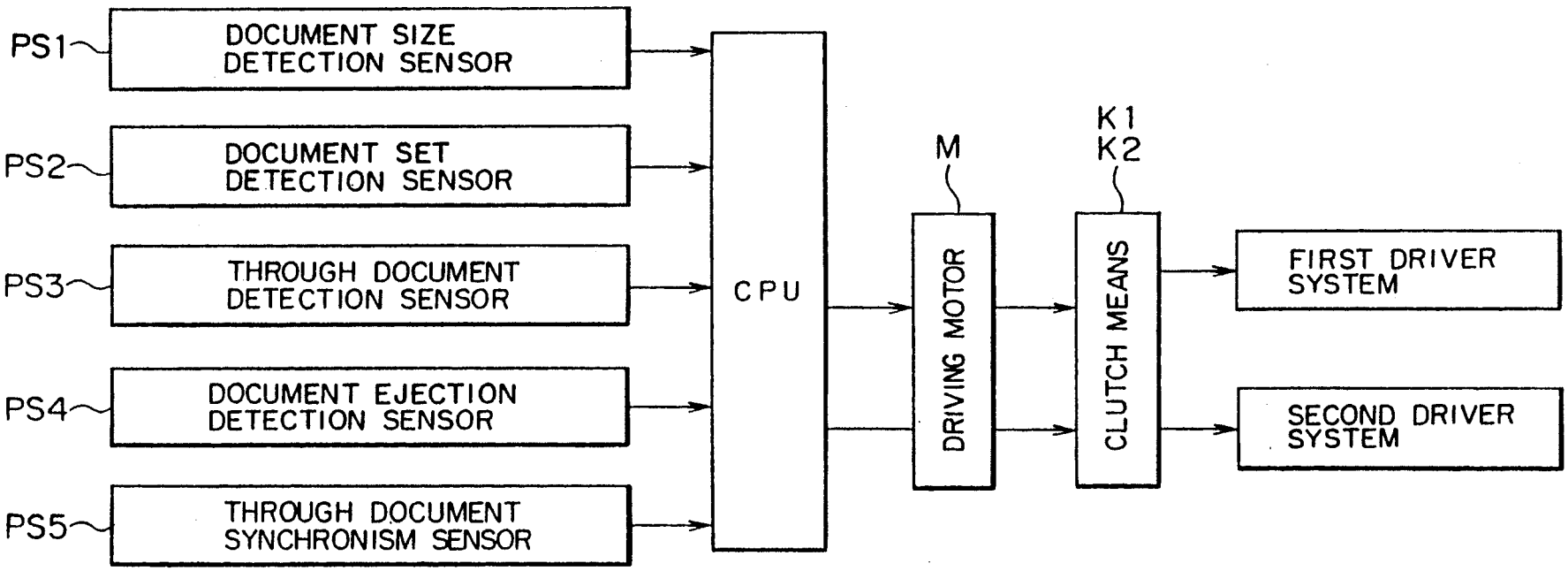
FIG. 8 is a block diagram of the driving system and FIG. 9A and 9B is a time chart of feeding/transporting a document.
Figure 9A:
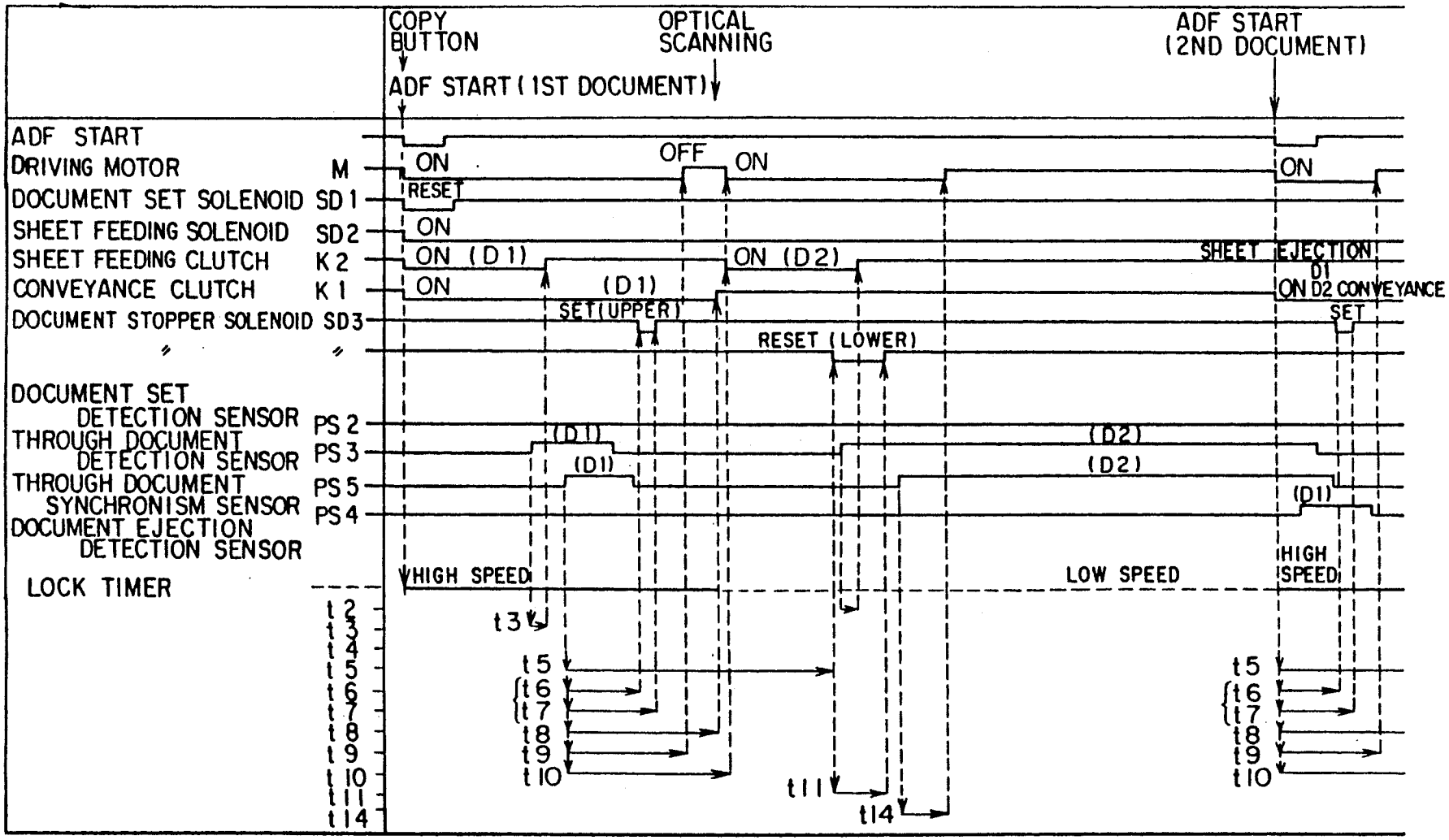
Figure 9B:
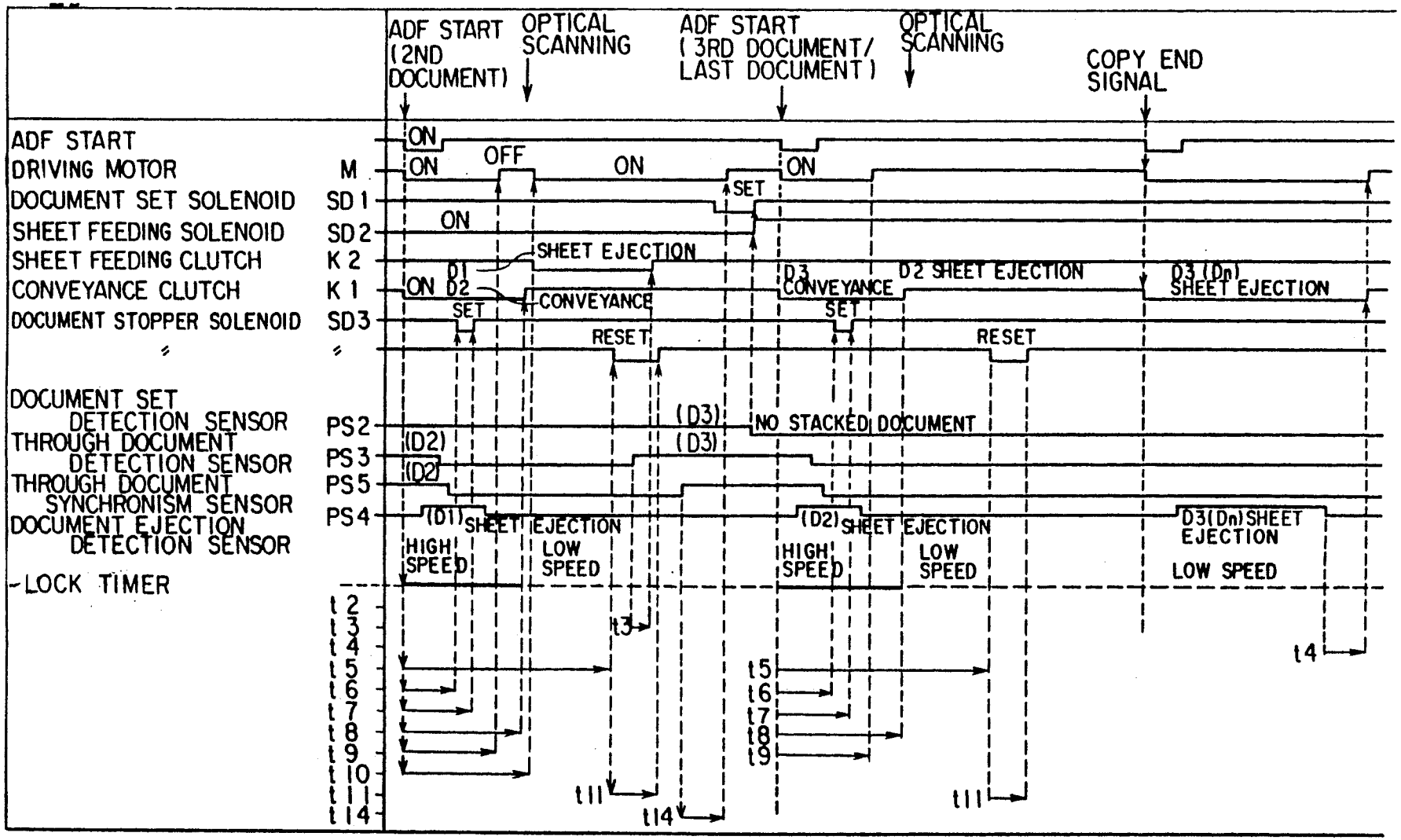

Next, FIGS. 6 (B) and (C) are illustrations showing how a document is fed and conveyed, FIG. 7 is a table showing the speed of revolution of each sheet feed roller at each driving system, FIG. 8 is a block diagram of driving systems and FIGS. 9 (A) and (B) represent a time chart.

Referring to aforesaid diagrams as well as the names of portions in FIG. 1 and FIG. 2 shown previously, how the automatic document sheet conveyance device is driven and how the document is conveyed will be explained.

(1) When stacked documents are loaded on document tray 1 and are positioned so that they hit document leading edge stopper 1D that is in its upper position, document set detection sensor PS2 detects existence of a document and sets to ADF mode.

(2) When document side edge guide plates 1A and 1A are moved until they contact the sides of a stack of documents, document size detection sensor PS1 detects the width of the document and CPU calculates the length of the document by converting from the width and stores it.

(3) When copy button 111 is pressed, signals for the start of copying are inputted and both copying machine main frame 100 and automatic document sheet conveyance device are started.

(4) The signals for starting ADF apply voltage on document set solenoid SD1 and thereby lower the tip of document leading edge stopper lD. Concurrently with that, voltage is applied on sheet feed solenoid SD2 and thereby pick-up roller 2 falls to contact, with pressure, the uppermost sheet of a stack of documents.

(5) Concurrently with the foregoing, the start of driving motor M causes sprocket pulley P1 on motor driving shaft 20 to rotate and thereby causing intermediate shaft 21 having thereon sprocket pulley P1 to rotate through timing belt B1. In this case, electromagnetic clutches K1 and K2 are on the energized state and accordingly feed roller shaft 22 is rotated by timing belt B3 to drive feed belt 3 through gears G1 and G2 and feed roller 3A and further to rotate pick-up roller 2 through timing belt B4. At the same time, sprocket pulley P7 engaging with aforesaid timing belt B3 is rotated to turn intermediate conveyance roller shaft 23, thus intermediate conveyance roller shaft 5 is brought into the state of running.

Concurrently with the foregoing, timing belt B2, engaging with aforesaid intermediate shaft 21, rotates conveyance belt driving roller 9 having thereon sprocket pulley P5, thus conveyance belt 8 that is spread between conveyance belt driving roller 9 and driven roller 10 is driven. In this case, circumferential speed for each of pick-up roller 2, feed belt 3, intermediate conveyance roller 5 and conveyance belt 8 is in a high speed conveyance mode $v_1$ (e.g. circumferential speed $v_1=1200$ mm sec).

Rotation of aforesaid rollers (2 and 5) and operation of belts (3 and 8) cause document D1 that is the uppermost sheet of document among stacked documents on document tray 1 to be fed out by pick-up roller 2, and document D1 is separated from other documents by feed belt 3 and double-feed-prevention roller 4 and is fed.

(6) When the leading edge of aforesaid document D1 fed out after being separated passes through through document detection sensor PS3, leading edge-passing signals are generated and the timer starts counting from the moment of the generation of signals, and after counting up to t3, sheet-feed clutch K2 is turned off. Due to this, after the leading edge of document D1 passes through the position of a nip formed by intermediate conveyance roller 5, the rotations of both pick-up roller 2 and feed-belt 3 are changed from driving rotation to driven rotation.

(7) Intermediate conveyance roller 5 continues rotating to feed document D1 which then passes through document synchronism sensor PS5 and slides at a high speed conveyance mode on platen glass 101 while being sandwiched with pressure between the platen glass and running conveyance roller 8.

(8) After counting up to t6 from the moment when the document passes aforesaid synchronism sensor PS5, latch type document stopper solenoid SD3 is operated, and it is kept at the counting up to t7, thus document stopper 102 is held in the manner that it is protruded from the upper surface at left side of platen glass 101.

(9) After counting up to t9 from the moment when the document passes aforesaid synchronism sensor PS5, driving motor M is turned off for the momentary suspension when the leading edge of document D1 arrives at the position that is slightly before document stopper 102, and also motor brakes are applied so that inertia may bring document D1 to the position where the document contacts the document stopper. Incidentally, the driving motor is turned off when the leading edge of the document arrives at the position that is 5 mm to 10 mm before the document stopper in the present example.

(10) After that, conveyance clutch K1 is turned off at the counting point of t8 and thereby suspending conveyance belt 8, thus document D1 in the state of suspension is pressed against platen glass 101. At about the same time, the clock is changed from a high speed mode to a low speed one.

(11) At the counting point of t10, sheet-feed clutch K2 is turned on and driving motor M is driven, thereby sheet feeding for the next document by means of pick-up roller 2 and feed roller 3 is started.

When the document is under the stationary condition in the image exposure section, the scanning exposure by means of optical system 103 on the copying machine main frame 100 side is started. In this case, before or during the scanning exposure, next document D2 is fed out and then conveyed through feed roller 3 and intermediate conveyance roller 5, when the leading edge of next document D2 passes through document detection sensor PS3, detection signals are generated and sheet-feed clutch K2 is turned off at the timer counting point of t2, thus the next document D2 is suspended at its standby position. During this period, electromagnetic clutch K1 for conveyance keeps to be off and therefore preceding document D1 in the process of exposure is in the state of suspension. During this period, however, following document D2 is conveyed at low speed conveyance mode v2 (e.g. $V_2=500$ mm/sec) and then is stopped temporarily to be on standby with its leading edge positioned at the point which is in the vicinity of platen glass 101 and is in the lower side of intermediate conveyance roller 5 in terms of sheet-feed direction.

Namey, the counting of t3 by means of a timer is started from the moment when the leading edge of following document D2 passes through document detection sensor PS3, and after t2, sheet-feed clutch K2 is turned off and thereby the sheet-feeding is suspended. Next, after the counting of t14 counted by a timer from the moment when the leading edge of the document D2 passes document synchronism sensor PS5, driving motor M discontinues driving. Incidentally, the leading edge of document $D_n$ positioned at aforesaid temporary stop position S is at the position where the document is not pressed by conveyance belt 8 in the vicinity of platen glass 101. Therefore, the leading edge is close to the trailing edge of preceding document.

Incidentally, within a prescribed period of time for the return traveling of the optical system that scans a document for exposure, document stopper solenoid SD3 is actuated with counting t5 and t11 to withdraw to the under side of platen glass 101 so that document D1 may pass when it is ejected.

(12) Next, when the scanning exposure is completed, ADF start signals are generated from copying machine main frame 100 and thereby the exposure operation for the second document D2 is performed. Namely, when both driving motor M and electromagnetic clutch K1 for conveyance are turned on, preceding document D1 is conveyed by conveyance belt 8 and then ejected onto sheet-ejection tray 14 through sheet-ejection roller 13. At the same time, following document D2 starts from the standby position and slides on platen glass 101 while being sandwiched and aforesaid stop operation stops the document at document stopper 102, thus the change of documents is completed. Document transport with the counting t8 by means of timer in this case is in high speed conveyance mode $v_1$.

(13) Aforesaid ADF start signals cause all of timer t5, t6, t7, t8, t9 and t10 to start at the same time. Timer 6 and timer 7 are for setting document stopper solenoid SD3, while timer 5 and timer t11 are for resetting the solenoid SD3. Timer 8 generates signals for turning off conveyance clutch K1. Further, timer t9, timer t10 and timer t14 are for controlling turning on and turning off for driving motor M.

Second document D2 is conveyed, on a high speed mode $v_1$, onto platen glass 101 from aforesaid temporary stop position S, and is conveyed by inertia until the document hits document stopper 102 and is stopped, after being stopped temporarily at the counting t9. After that, the document is operated in the same way as in aforesaid preceding document D1 including exposure and ejection. During this period, third document D3 is conveyed to standby position S where it stops. FIG. 6 (B) is an illustration showing how a document is conveyed.

Even for the third document D3, operations of feeding, conveyance, exposure and ejection are performed as in the foregoing.

FIG. 6 (B) is an illustration showing how a document is fed and conveyed, for the last document $D_n$ D3 in FIG. 9 (B) and its preceding document $D_{n-1}$ D2 in FIGS. 9 (A), (B)

FIG. 6 (C) is an illustration showing how the last document $D_n$ is ejected.

When scanning exposure is completed for the last document $D_n$, copy end sigmals are inputted from copying machine main frame 100. The copy end signals cause both driving motor M and conveyance clutch K1 to be turned on, thereby conveyance belt 8 runs and the friction force caused by the pressure of conveyance belt 8 drags document $D_n$ on platen glass 101 and sends it out toward sheet-ejection roller 13. After the counting t4 from the moment when sheet-ejection sensor PS4 detects the trailing edge of document $D_n$, driving motor M and conveyance clutch K1 are turned off, thus completing the operations.

Before aforesaid last document $D_n$ is ejected from platen glass 101 to the outside of a machine, high speed conveyance node $V_1$ has been changed to low speed conveyance mode $V_2$ since the start of scanning exposure for the document $D_n$. Therefore, the last document $D_n$ is conveyed on platen glass 101 by pressurized friction force at the low speed conveyance mode (e.g. 500 mm sec , passes over document stopper 102 withdrawn downward with timer t5 and timer t11, passes sheet-ejection sensor PS4 and is squeezed by sheet-ejection roller 13 to be ejected out of a machine.

In the sheet-ejection process for the last document $D_n$, conveyance belt 8 is running at low speed conveyance mode $V_2$. Therefore, even if the area for direct contact between conveyance belt 8 and platen glass 101 increases gradually as the ejection of document $D_n$ advances as shown in FIG. 6 (C) and thereby friction resistance between them increases, conveying force of conveyance belt 8 is great and transmission of driving force from driving roller 9 connected to driving motor M is assured, thus causing no slip between the driving roller 9 and conveyance belt 8. Due to such prevention of slip occurrence, defective sheet ejection caused by unstable running of conveyance belt 8 has been solved.

In the present example, aforesaid two driving systems are controlled and operated by one motor and two electromagnetic clutches. However, the same operations may be conducted by two motors and one electromagnetic clutch.

Even in the case of copying two-sided document wherein a document is conveyed reversely to document-reversing section 30 to be reversed and then is conveyed again to the platen glass, it is possible to obtain the same effect if the temporary stop position for the document is set in the same way as in the aforesaid case by counting from the moment of passage and detection of through reversed document detection sensor PS5.

Furthermore, the invention is not limited to the above-mentioned example, and the low speed handling for the last document can be applied to an automatic document sheet conveyance device that starts feeding the succeeding document after confirming the ejection of the preceding document and to an automatic document sheet conveyance device that starts feeding the succeeding document from the position of stacked documents concurrently with the start of ejection for the preceding document.

Incidentally, when all copy papers in a paper-supply cassette or a paper-supply tray are used up on the half way of aforesaid series of copying operations, a control device makes a no-paper indication on abnormality-display section 116 based on no-paper information from an unillustrated copy-paper sensor for detecting no-paper provided on the paper-supply cassette or the paper-supply tray and suspends the copying operations temporarily when the last copy paper is ejected on a copy paper ejection tray. This temporary suspension is one wherein a series of copying operations suspended temporarily can be resumed as if there was no temporary suspension when copy papers are loaded again, the copy-paper sensor sends paper-existing information to the control device, and copy button 111 is pressed. Namely, on the occasion of a temporary suspension, the control device keeps the conditions for copying at the time of the temporary suspension including the indications on number of copies display portion 113 and on number of documents display portion 115 so that they may further be used after the temporary suspension. Thereby, it is possible to get quickly the copies in quantiy set for each document stacked on document tray 1, despite the temporary suspension caused by no paper.

However, when a stop-clear key or a ten-key is pressed during the period of temporary suspension, the control device causes the conditions for copying at the time of the temporary suspension to be released, causes number of documents indication section 115 to indicate 0, causes number of copies indication section 113 to indicate 1 or the number of copies set by the ten-key device, and causes motor M to rotate at least pressure-feeding roller 5 and conveyance belt 8 on a platen in the arrowed direction, thus ejecting a document in the exposure section and a document in a standby position onto document-ejection tray 14. In this case, though electromagnetic clutch K1 is turned on while motor M is running, electromagnetic clutch K2 is left to be off so that no document on document tray 1 may be fed out, or electromagnetic clutch K2 is also turned on and friction-feeding roller 2 is left to be on the solid line because the conveyance resistance of a document in a standby position is high. As for the speed of revolution of motor M in this case, the one that is lower than that for feeding the document onto platen glass 101 is preferable for the purpose of ejecting surely the documents one is in the exposure position and the other is in the standby position onto document ejection tray 14 in regular sequence. Under such arrangement, when documents ejected onto document-ejection tray 14 are returned to document tray 1 and copy button 111 is pressed, for example, it is possible to obtain quickly the copies in quantity set anew for each of all documents.

Further, when jamming happens in the copy paper transport system on the half way, the control device prohibits, based on signals of the jamming, the document ejection detection sensor PS4 from counting for document detection, and drives and stops the section from friction-conveyance roller 17 to sheet-ejection roller 13 in the same manner as that for ejecting the document already fed out from document tray 1 onto document ejection tray 14, and thereby immediately stops copying operations such as the rotation of a photoreceptor drum and the driving for the copy paper transport system. The speed of revolution of motor M in FIG. 3 in this case is lower than that for feeding the document in the exposure section and that for ejecting simultaneously the document positioned in the exposure section onto document ejection tray 14. Thus, the document in the exposure section and the document in the standby position can be ejected surely and in regular sequence onto document-ejection tray 14. After a jammed paper is cleared and documents ejected onto document-ejection tray 14 due to jam signals are returned to document tray 1 in the original sequence, if copy button 111 is pressed, a series of copying can be continued as if there occurred no jamming.

In case of jamming occurring on documents, on the other hand, signals derived from the jamming cause the control device to suspend immediately the operation of automatic document sheet conveyance device 30. With regard to the rotation of the photoreceptor drum and operation of the copy paper transport system, however, the control device suspends them after the copying for the number of copies set for the document on platen glass 101 is completed. If copy button 111 is pressed after the jammed document is cleared and returned, if possible, to document tray 1, a series of copying operations can be continued as if there occurred no jamming.

When a stop-clear key is pressed on the half way, the control device ejects, based on signals thereafter, a document in the exposure position and a document in the standby position through the document conveyance system in the same manner as in jamming taking place in copy paper transport system, after the exposure is completed for the document positioned in the exposure section when the signals are inputted. Then, the control device stops all the copying operations when a finished copy corresponding to the last exposure operation is almost ejected onto the copy paper ejection tray. In this case, when copy start button 1 is pressed next, a series of copying operations are performed from the first for the documents on document tray 8.

The control device, after receiving no-document information from first document sensor 11, causes document number indicating portion 40 to keep indicating the number of documents for the period of time from the time of inputting of document detection information coming from third document sensor 13 to the prescribed time given by a timer or a pulse-counter, or when any one of the occasions that key-group 2 for inputting information about next copying operations is pressed by that time, next documents are loaded on document tray 8 and first document sensor 11 has sent document-existing information to the control device, or automatic document sheet conveyance device 7 is released and conveyance device releasing sensor 24 has sent releasing information to the control device has been performed, for the period of time from the time of inputting of document detection information coming from third document sensor 13 to the moment when aforesaid occasion has been performed, and after that, the control device causes document number indicating portion 40 to discontinue the indication. The last indication of the number of documents shows the number of documents loaded on document tray 1, or it shows whether the double feeding has occurred or not when the number of documents to be loaded on document tray 1 is known in advance.

An automatic document sheet conveyance device of the invention is not limited to the examples stated above, and the position for standby preceding the exposure section may also be fixed regardless of the size of a document.

As stated above, an automatic document sheet conveyance device of the invention offers remarkable effects in particular when it is used as a high-performance automatic document sheet conveyance device capable of shortening document-change time by means of high-speed conveyance for documents. Namely, for the ejection of the last document, the problem of improper ejection of document caused by the slip of a conveyance belt and consequent its unstable running which has taken place in high-speed conveyance by means of a conventional conveyance belt has been solved by the invention, and a document sheet can be ejected surely and properly. Further, troubles such as damage of each member caused by wear, heat-generation and overload for driving rollers, a driving motor and bearing members all further caused by the slip between a conveyance belt and a driving roller have been solved totally, resulting in excellet effects on durability and releability of a device.

Furthermore, it is possible to raise the productivity of copying in the case of a plurality of documents on an automatic document sheet conveyance device of the invention because the time required for the second document and thereafter to be fed from the document tray to the exposure section is shortened, and even when the copying operations are suspended due to exhausted copy paper, it is possible to obtain easily the exact number of copies set for each of all documents. When an action for setting the number of copies is taken during the aforesaid temporary suspension, it is possible to conduct easily without any trouble the new copying operations based upon the number of copies thus set accordingly.

Further, on a copying machine provided with an automatic document sheet conveyance device of the invention, the productivity of copying is high, and even when jamming takes place in the copy paper transport system, the copying operations can be continued easily and documents are always ejected correctly onto a document ejection tray.

What is claimed is:

1. An automatic document conveyance apparatus for use with a photoelectric copying device for copying an image of a document, at a document copying position of said photoelectric copying device, onto a copying sheet, comprising:

first conveyance means for conveying a plurality of documents in a sheet form one-by-one to a document waiting position in said document conveyance apparatus;

second conveyance means for conveying said documents from said documents waiting position to said document copying position;

third conveyance means for conveying said documents from said document copying position to a position outside of said photoelectric copying device after a copying operation of said photoelectric copying device; and means for controlling the second and third conveyance means so that a document held at said document waiting position and a document at said document copying position are automatically ejected outside of said automatic document conveyance apparatus when a copying operation is cancelled, wherein the second conveyance means includes means for holding one of said documents conveyed to said document waiting position thereat until said copying operation for another of said documents previously conveyed to said document copying position is ended.

2. An automatic document conveyance apparatus for use with a photoelectric copying device for copying an image of a document, positioned at a document copying position of said photoelectric copying device, onto a copying sheet, comprising:

first conveyance means for conveying a plurality of document in a sheet form one-by-one to a document waiting position in said document conveyance apparatus;

second conveyance means for conveying said documents from said document waiting position to said document copying position;

third conveyance means for conveying said documents from said document copying position to a location outside of said photoelectric copying device, after a copying operation of said photoelectric copying device; and, means for controlling the conveyance speed of at least one of said first conveyance means, said second conveyance means, and said third conveyance means, when said copying sheet jams in said document copying device, to be a non-zero speed which is lower than that of said least one conveyance means when said document copying device operates a copying operation, wherein the second conveyance means includes means for holding one of said documents conveyed to said document waiting position thereat until said copying operation for another of said document previously conveyed to said document copying position is ended.

3. The document conveyance apparatus claimed in claim 2, wherein said means for controlling the conveyance speed also includes means for controlling the conveyance speed of at least one of said first conveyance means, said second conveyance means, and said third conveyance means, after a copying operation of said document copying device is cancelled, to be a non-zero speed which is lower than that of said at least one conveyance means when said document copying device operates said copying operation.

4. An automatic document conveyance apparatus for use with a photoelectric copying device for copying an image of a document, at a document copying position on a platen of said photoelectric copying device, onto a copying sheet, comprising:

first means for separating and conveying a plurality of documents in a sheet form one-by-one to an intermediate position;

second means for conveying said documents from said intermediate position to said document copying position and then conveying said documents from said document copying position to a document ejecting position, which position is not on said platen, the second means including a conveyance belt covering said platen so as to slide said document on said platen;

said conveyance belt capable of simultaneously sliding two sheets of said documents on said platen so that, after copying the image of a first document at said document copying position, said conveyance belt ejects said first document from said document copying position to said document ejecting position while conveying a following second document from said intermediate position to said document copying position; and means for controlling said second means to move said conveyance belt at a high or low speed so that, when said conveyance belt simultaneously slides two sheets of said documents on said platen, said second means moves said conveyance belt at said high speed, and when said conveyance belt slides a single sheet of said documents on said platen, said second means moves said conveyance belt at said low speed to reduce friction between said conveyance belt and said platen.

5. The apparatus of claim 4, wherein said controlling means includes means for controlling said second means to move said conveyance belt at said low speed when said conveyance belt slides a single sheet of said documents and when said second means ejects the last sheet of said document.

6. The apparatus of claim 4, wherein said controlling means includes means for controlling said second means to move said conveyance belt at said low speed when said conveyance belt slides a single sheet of said documents and when said second means ejects a document remaining on said platen simultaneously with stopping the copying of an image of the document.

7. The apparatus of claim 4, wherein said controlling means includes means for controlling said first means to convey said following second document to said intermediate position while said conveyance belt is stopped to hold the first document at said document copying position.

8. The apparatus of claim 7, wherein said first means comprises a feed roller to convey the plurality of documents, and said control means include means for controlling said first means to move said feed roller at a high or low speed so that, when said first means conveys said following second document to said intermediate position, said first means moves said feed roller at said low speed.

9. The apparatus of claim 8, wherein the control means further include means for controlling said means to move said feed roller at said high speed when there is not a preceding document on said document copying position and said first means conveys a first document.

* * * * *